US011931618B2

(12) United States Patent
Meredith

(10) Patent No.: US 11,931,618 B2
(45) Date of Patent: Mar. 19, 2024

(54) LOCKING MECHANISM FOR SIMULTANEOUSLY POSITIONING AN EXERCISE ARM IN TWO PERPENDICULAR DIRECTIONS

(71) Applicant: HOIST FITNESS SYSTEMS, INC., Poway, CA (US)

(72) Inventor: Jeffrey O. Meredith, Del Mar, CA (US)

(73) Assignee: HOIST FITNESS SYSTEMS, INC., Poway, CA (US)

( * ) Notice: Subject to any disclaimer, the term of this patent is extended or adjusted under 35 U.S.C. 154(b) by 122 days.

(21) Appl. No.: 17/880,461

(22) Filed: Aug. 3, 2022

(65) Prior Publication Data

US 2023/0040364 A1 Feb. 9, 2023

Related U.S. Application Data

(60) Provisional application No. 63/230,267, filed on Aug. 6, 2021.

(51) Int. Cl.
*A63B 21/062* (2006.01)
*A63B 71/06* (2006.01)

(52) U.S. Cl.
CPC ..... *A63B 21/0622* (2015.10); *A63B 21/0632* (2015.10); *A63B 2071/0694* (2013.01)

(58) Field of Classification Search
CPC ..... A63B 21/0622; A63B 21/0628; A63B 21/0632; A63B 21/156; A63B 21/4035; A63B 23/1209; A63B 2071/0694; A63B 2225/09
See application file for complete search history.

(56) References Cited

U.S. PATENT DOCUMENTS

| | | | |
|---|---|---|---|
| 1,535,391 | A | 4/1925 | Anderson |
| 3,782,721 | A | 1/1974 | Passera |
| 3,858,873 | A | 1/1975 | Jones |
| 4,415,063 | A | 11/1983 | Hutchison |
| 4,505,475 | A | 3/1985 | Olschansky et al. |
| 4,603,855 | A | 8/1986 | Sebelle |

(Continued)

FOREIGN PATENT DOCUMENTS

KR 101166981 B1 7/2012

OTHER PUBLICATIONS

United States International Searching Authority, International Search Report and Written Opinion for corresponding International Application No. PCT/US2022/039306, dated Nov. 1, 2022, 8 pages.

*Primary Examiner* — Joshua Lee
(74) *Attorney, Agent, or Firm* — David R. Heckadon; Gordon Rees Scully Mansukhani LLP

(57) ABSTRACT

A locking and release mechanism for simultaneously positioning an exercise arm in two perpendicular directions, having: (a) a first positioning guide for positioning an exercise arm in a first direction; (b) a second positioning guide for positioning the exercise arm in a second direction; and (c) a locking and release mechanism for locking and releasing the first and second positioning guides, wherein the locking and release mechanism includes: a moveable tab, and one or more positioning pins, wherein movement of the moveable tab locks one two positioning pins into apertures in each of the first and second positioning guides.

15 Claims, 10 Drawing Sheets

(56) References Cited

U.S. PATENT DOCUMENTS

| | | | | |
|---|---|---|---|---|
| 4,666,149 | A | 5/1987 | Olschansky et al. | |
| 4,684,125 | A | 8/1987 | Lantz | |
| 4,844,456 | A | 7/1989 | Habing et al. | |
| 4,858,915 | A | 8/1989 | Szabo | |
| 4,973,043 | A | 11/1990 | Nolan | |
| 5,419,749 | A | 5/1995 | Morgenstein | |
| 5,921,902 | A | 7/1999 | Carpenter | |
| 6,238,323 | B1 | 5/2001 | Simonson | |
| 6,387,020 | B1 | 5/2002 | Simonson | |
| 6,443,874 | B1 | 9/2002 | Bennett | |
| 6,443,877 | B1 | 9/2002 | Hoecht et al. | |
| 6,458,061 | B2 | 10/2002 | Simonson | |
| 6,488,612 | B2 | 12/2002 | Sechrest et al. | |
| 6,508,748 | B1 | 1/2003 | Ish, III | |
| 6,592,498 | B1 | 7/2003 | Trainor | |
| 6,692,416 | B1 | 2/2004 | Davis | |
| 6,712,740 | B2 | 3/2004 | Simonson | |
| 7,169,093 | B2 | 1/2007 | Simonson et al. | |
| 7,179,209 | B2 | 2/2007 | Sechrest et al. | |
| 7,282,016 | B2 | 10/2007 | Simonson | |
| 7,601,105 | B1 | 10/2009 | Gipson, III et al. | |
| 7,815,552 | B2 * | 10/2010 | Dibble | A63B 21/154 482/92 |
| 7,909,742 | B2 | 3/2011 | Ish, III et al. | |
| 7,998,036 | B2 | 8/2011 | Ish, III | |
| 8,002,677 | B2 * | 8/2011 | Dibble | A63B 21/4047 482/92 |
| 8,057,368 | B1 * | 11/2011 | Lyszczarz | A63B 21/0628 482/142 |
| 10,016,646 | B2 | 7/2018 | Butler | |
| 10,335,626 | B2 | 7/2019 | Orady et al. | |
| 10,500,442 | B2 * | 12/2019 | Hong | A63B 21/156 |
| 10,617,903 | B2 | 4/2020 | Orady et al. | |
| 11,207,564 | B2 * | 12/2021 | Ward | A61B 5/1126 |
| 11,602,662 | B2 * | 3/2023 | Horvath | A63B 21/169 |
| 2001/0023221 | A1 | 9/2001 | Simonson | |
| 2002/0013200 | A1 | 1/2002 | Sechrest et al. | |
| 2003/0017918 | A1 | 1/2003 | Webb et al. | |
| 2003/0032530 | A1 | 2/2003 | Sechrest et al. | |
| 2003/0032531 | A1 | 2/2003 | Simonson | |
| 2005/0202941 | A1 | 9/2005 | Vaes | |
| 2006/0100069 | A1 | 5/2006 | Dibble et al. | |
| 2006/0116249 | A1 * | 6/2006 | Dibble | A63B 23/03525 482/72 |
| 2006/0160676 | A1 | 7/2006 | Sato | |
| 2006/0189457 | A1 | 8/2006 | Ripley | |
| 2007/0093364 | A1 | 4/2007 | Batca | |
| 2007/0117691 | A1 | 5/2007 | Sechrest et al. | |
| 2007/0161468 | A1 | 7/2007 | Yanagisawa et al. | |
| 2007/0167299 | A1 | 7/2007 | Simonson et al. | |
| 2007/0173384 | A1 | 7/2007 | Sechrest et al. | |
| 2008/0020912 | A1 | 1/2008 | Dalebout et al. | |
| 2008/0051263 | A1 | 2/2008 | Rasmussen et al. | |
| 2008/0300116 | A1 | 12/2008 | Eder | |
| 2011/0028281 | A1 | 2/2011 | Ish, III et al. | |
| 2011/0039665 | A1 * | 2/2011 | Dibble | A63B 23/03525 482/92 |
| 2015/0038300 | A1 | 2/2015 | Forhan et al. | |
| 2017/0361166 | A1 | 12/2017 | Hong et al. | |
| 2020/0114196 | A1 | 4/2020 | Habing et al. | |

* cited by examiner

LOCKING MECHANISM FOR SIMULTANEOUSLY POSITIONING AN EXERCISE ARM IN TWO PERPENDICULAR DIRECTIONS

RELATED APPLICATION

The present application claims priority to U. S. Provisional Patent Application Ser. No. 63/230,267, of same title, filed Aug. 6, 2021, the entire disclosure of which is incorporated herein by reference in its entirety for all purposes.

TECHNICAL FIELD

The present invention relates systems for moving and positioning arms on exercise machines into different locations such that a user can exercise different muscle groupings.

BACKGROUND OF THE INVENTION

Examples of systems for positioning the arms of exercise machines can be found in various U.S. Patents and Published Patent Applications including: U.S. Pat. No. 7,909,742 (entitled "Functional Training Exercise Apparatus And Methods") and 2006/0100069 (entitled "Exercise Device"). Other examples of exercise machines with positionable features include U.S. Pat. Nos. 6,443,877; 6,508,748; 7,169,093; 7,998,036; 8,251,877; 8,550,964; 10,016,646; 10,335,626; 10,617,903; and Published Patent Applications 2003/0017918 and 2020/0114196.

Unfortunately, all of these systems suffer from their own particular disadvantages. What is instead desired is a simple system in which the user only has to "flip a switch" or "depress a single tab" to release an exercise arm such that it can rapidly be positioned in two perpendicular directions (i.e.: simultaneously moved up and down and left to right). It is also important that this system be fast acting and easy to use. It is also important that such a system be able to firmly hold onto the exercise arm once it has been moved to its desired position and angle during the exercises. As will be shown, the present system offers these advantages.

SUMMARY OF THE INVENTION

In preferred aspects, the present system provides a locking and release mechanism for simultaneously positioning an exercise arm in two perpendicular directions, comprising:

(a) an exercise arm;

(b) a first positioning guide for positioning the exercise arm in a first direction;

(c) a second positioning guide for positioning the exercise arm in a second direction, wherein the first and second directions are perpendicular to one another; and (d) a locking and release mechanism for locking and releasing the first and second positioning guides, wherein the locking and release mechanism comprises:

(i) a moveable tab, and (ii) one or more positioning pins, wherein movement of the moveable tab locks the one or more positioning pins into apertures in each of the first and second positioning guides.

In various aspects, movement of the tab simultaneously moves two separate positioning pins (such that one positioning pin locks into each of the positioning guides). In this aspect, the moveable tab may be connected to a pair of levers, and one of the pair of levers moves each of the first and second positioning pins.

In other various aspects, movement of the tab moves a single positioning pin into the apertures in both of the first and second positioning guides. For example, a distal end of the single positioning pin may lock into the first positioning guide while a proximal end of the single positioning pin locks into the second positioning guide. In these aspects, a mid-section of the positioning pin may have a smaller diameter than either of the distal or proximal ends of the positioning pin, and the second positioning guide has a continuous slot spanning between the apertures therein. As such, the positioning pin may be moved to an unlocked position and slid to another aperture in the positioning guide.

In both the one or two positioning pin aspects of the present system, the locking and release mechanism preferably further comprises a biasing mechanism for keeping the positioning pin in a locked position. In addition, the first and second positioning guides are preferably located at a proximal end of the exercise arm.

In preferred aspects of the various embodiments of the present system, the user moves the tab up to lock the first and second positioning guides and down to unlock the first and second positioning guides. As such, the user can simultaneously move the exercise arm in two perpendicular directions once the locking and release mechanism has been released.

In further preferred aspects, safety features are included to either warn the user when the arms are not properly locked into position. In other aspects, safety features are included to release the positioning guides one after another such that the arms are first released for horizontal movement prior to being released for vertical movement. This has the advantage of preventing the arms from falling when they are first unlocked for re-positioning.

DETAILED DESCRIPTION OF THE DRAWINGS

Figure 1:
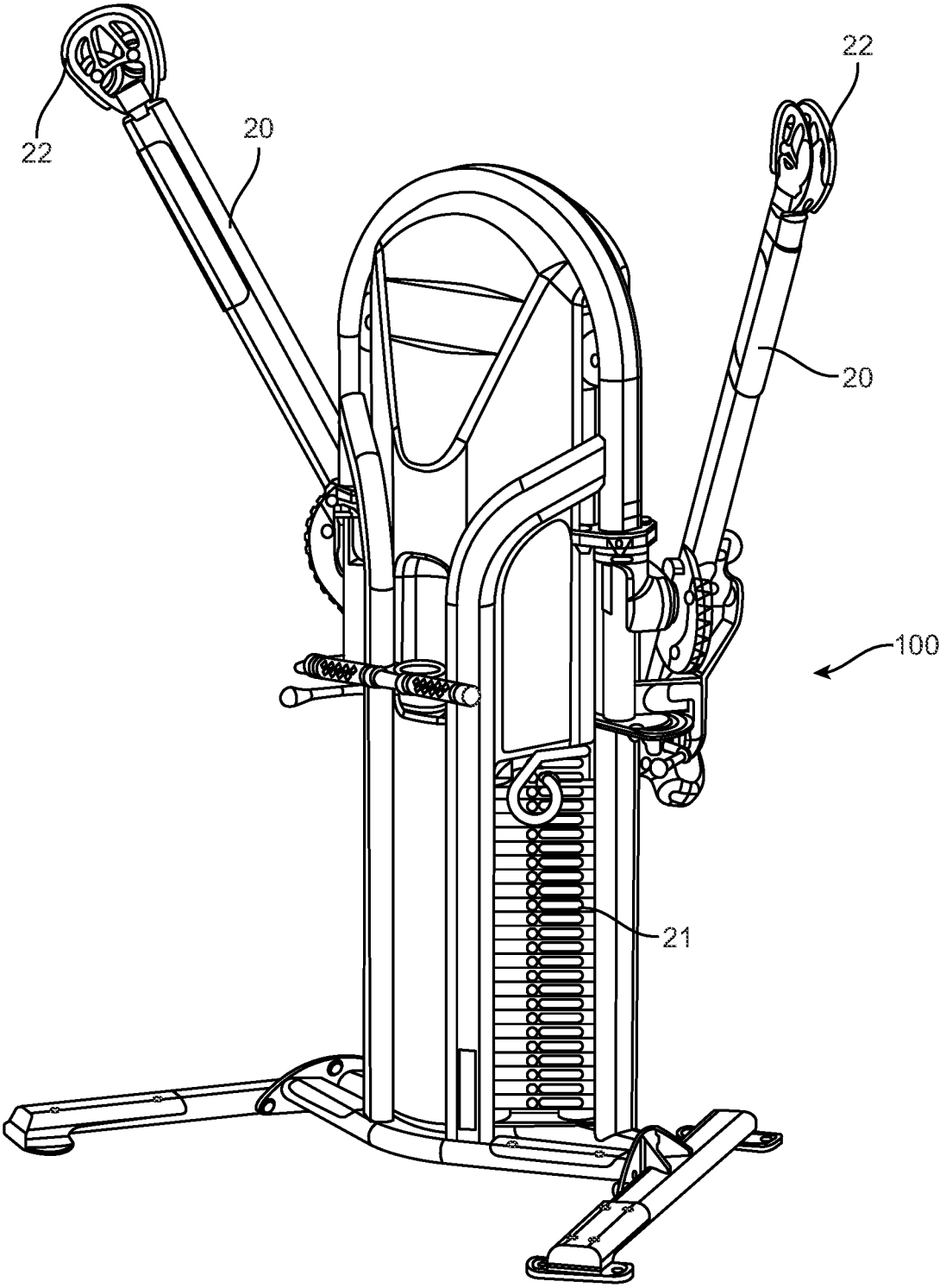
FIG. 1 is a front perspective view of a cable pull exercise machine that has a pair of arms that are each moveable in two perpendicular directions, with the arms shown in an outwardly rotated and raised position.
Figure 2:
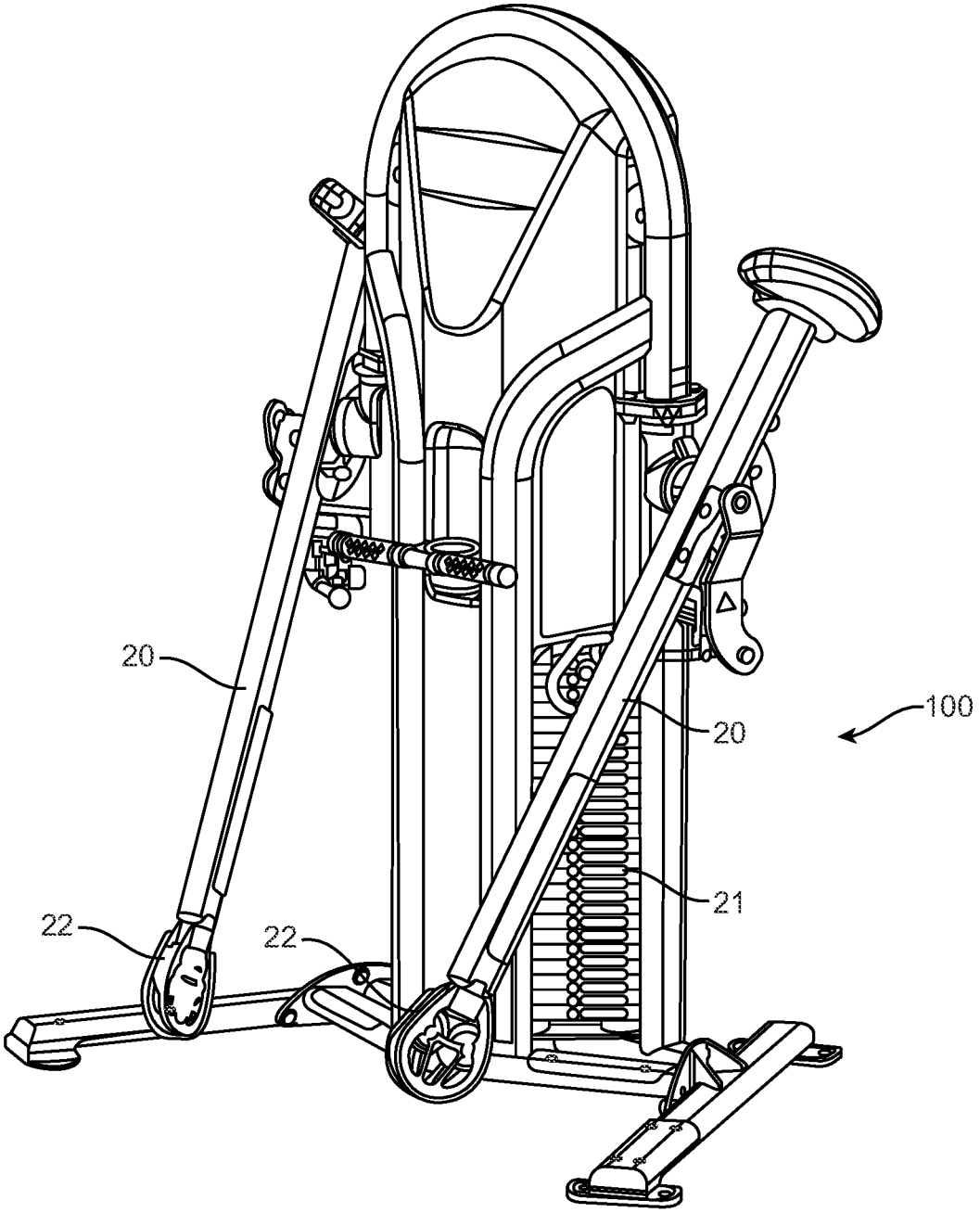
FIG. 2 is a front perspective view corresponding to the exercise machine of FIG. 1, but with the arms shown in an inwardly rotated and lowered position.
Figure 3:
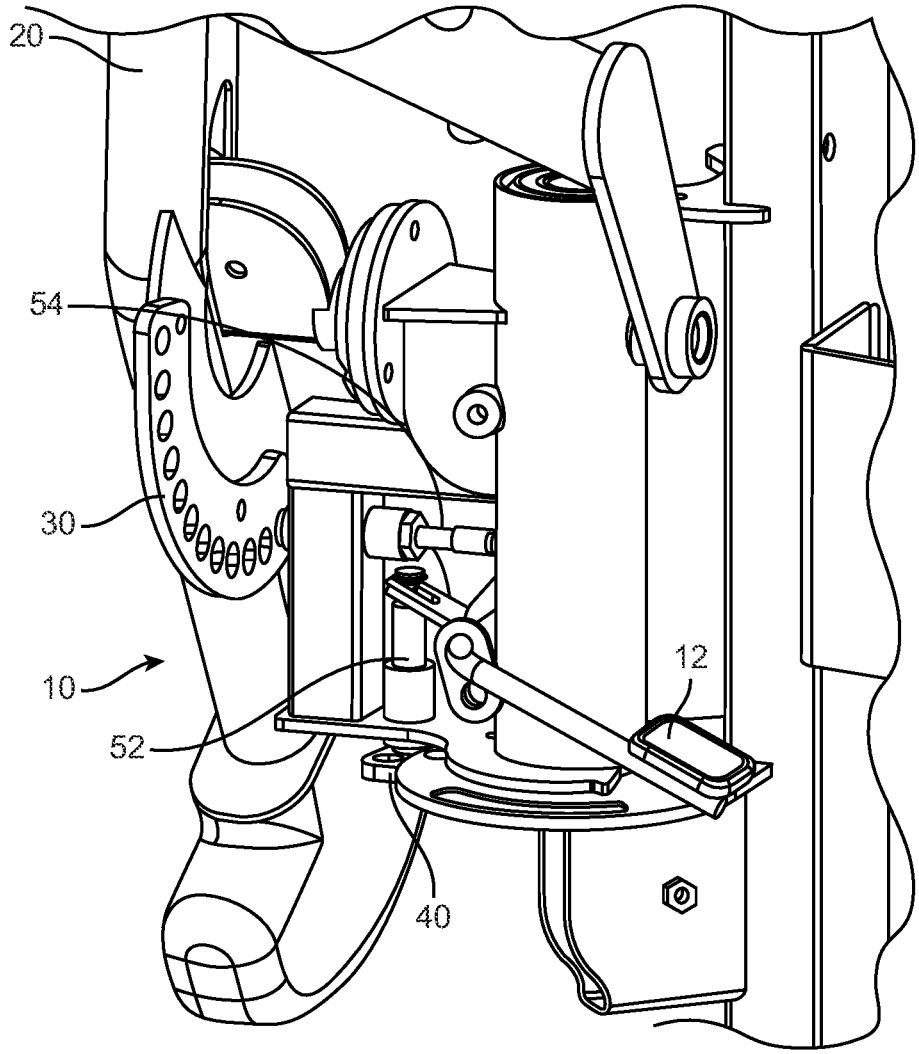
FIG. 3 is a perspective view of a first embodiment of the present system having two positioning pins.
Figure 4:
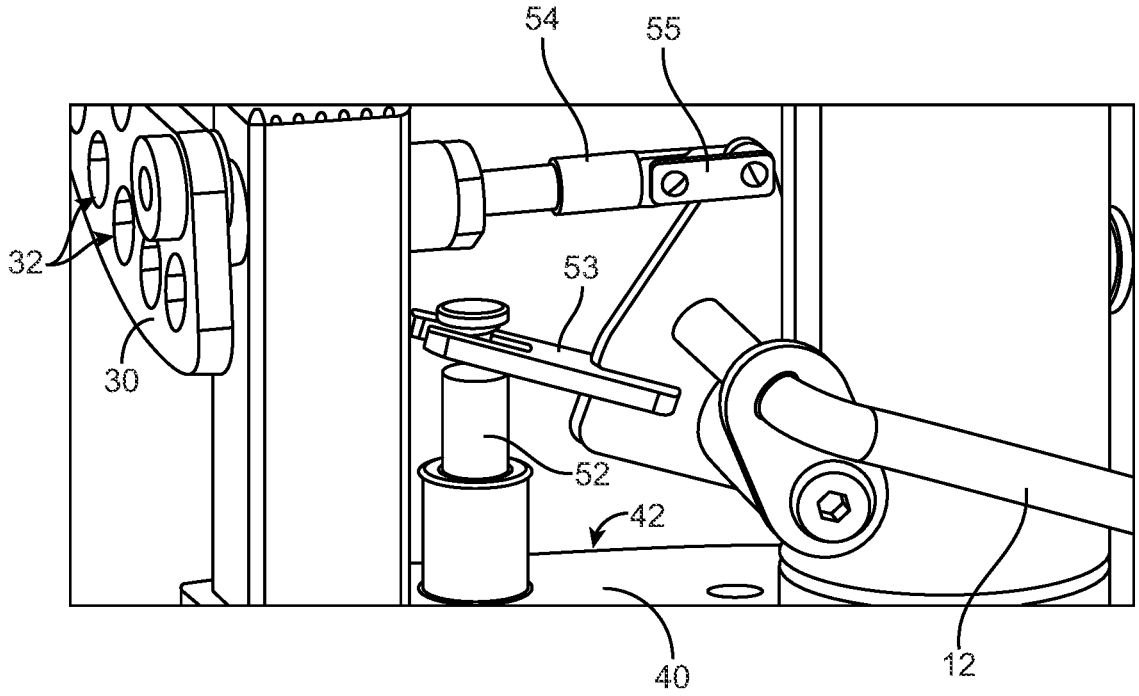
FIG. 4 is a close-up perspective view of the locking and release mechanism of the embodiment of FIG. 3.
Figure 5:
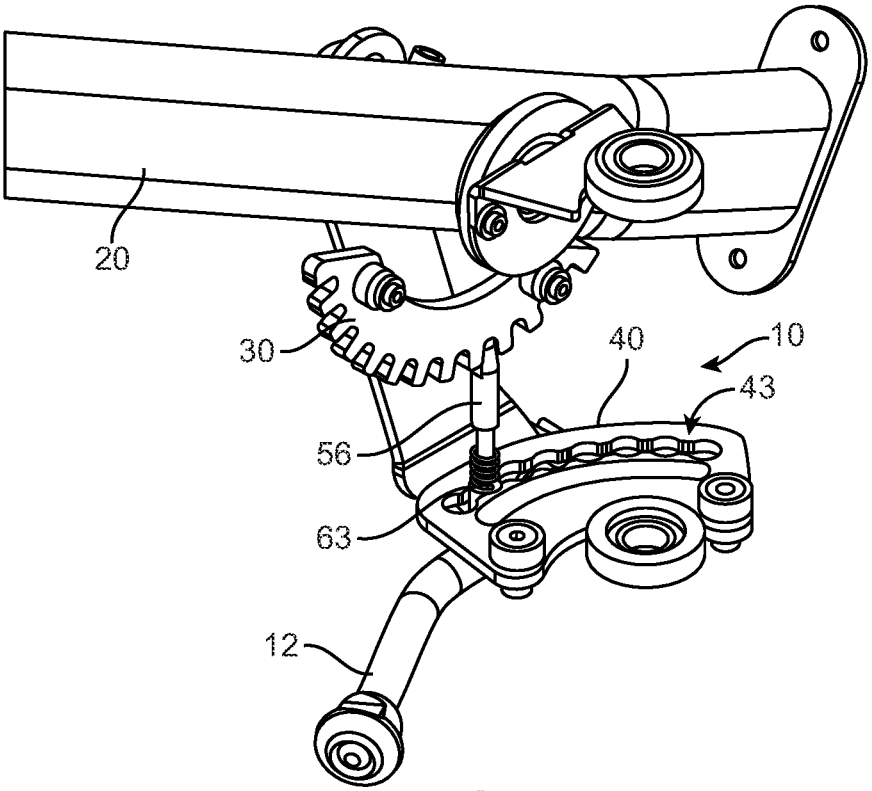
FIG. 5 is a perspective view of a second embodiment of the present system having only one positioning pin.
Figure 6:
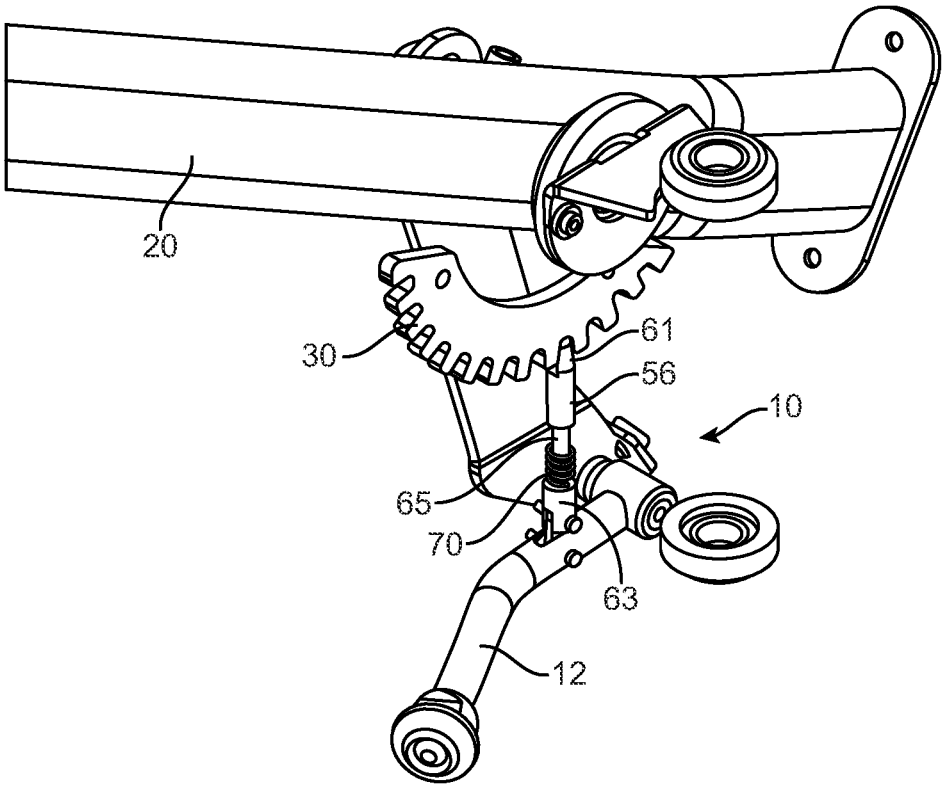
FIG. 6 is a view similar to FIG. 5, but with the second positioning guide removed to show further details of the positioning pin assembly.
Figure 7:
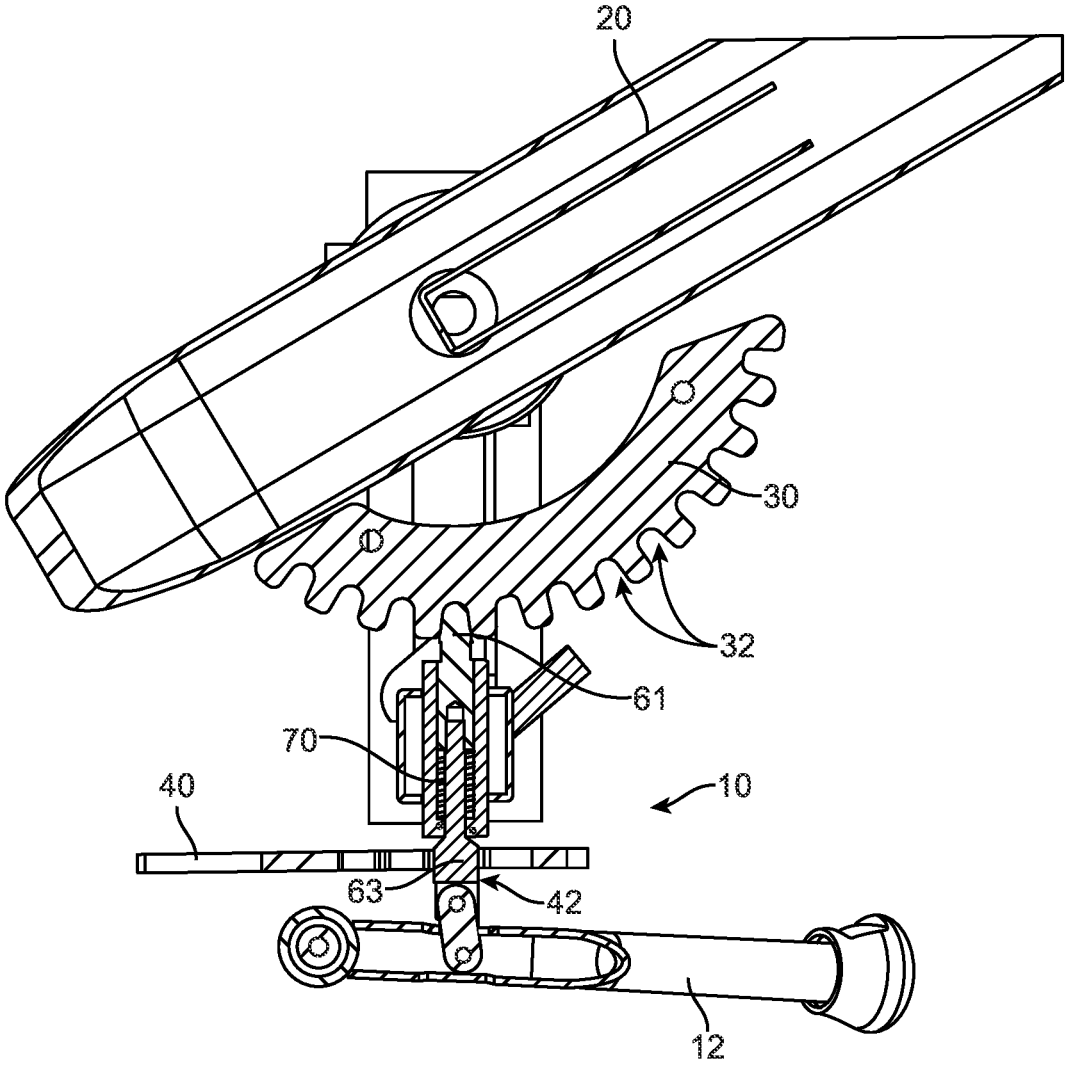
FIG. 7 is a sectional side elevation view of the embodiment of FIGS. 5 and 6.

In various aspects, the present system provides locking and release mechanism for simultaneously positioning an exercise arm in two perpendicular directions. FIGS. 1 and 2 illustrate views of the movement of the arms on an exemplary cable pull exercise machine. FIGS. 3 and 4 illustrate a first embodiment having two positioning pins and FIGS. 5, 6 and 7 illustrate a second embodiment having only one positioning pin. It is to be understood that the present invention and the claims attached hereto cover both of these two embodiments. Lastly, FIGS. 8A to 9B illustrate optional safety systems preventing unexpected arm movement during pre-positioning of the arms.

Referring first to FIGS. 1 and 2, an optional exercise machine 100 is provided. Exercise machine 100 may be a cable pull exercise machine having a pair of exercise arms 20. A cable pull cable (not shown for clarity) can be connected to weight stack 21, with cable ends wrapping around pulleys at arm ends 22. The user then pulls on the cables to raise the weights in weight stack 21. In accordance with the present system, the user moves ends 22 to various positions prior to pulling on the arm cables. As such, the user exercises different muscle groups when the ends 22 of arms 20 are in different positions. FIG. 1 shows arms 20 in an outwardly rotated and raised position, while FIG. 2 shows the arms in an inwardly rotated and lowered position. As will be shown, exercise arms 20 can be moved to a plurality of positions between these two outer limits of movement.

In various aspects as seen throughout the attached figures, the present system provides a locking and release mechanism 10 for simultaneously positioning an exercise arm in two perpendicular directions. The present system preferably comprises: an exercise arm 20; a first positioning guide 30 for positioning the exercise arm in a first direction; a second positioning guide 40 for positioning the exercise arm in a second direction (wherein the first and second directions are preferably perpendicular to one another); and a locking and release mechanism 10 for locking and releasing the first and second positioning guides 30 and 40. In preferred aspects, locking and release mechanism 10 comprises a moveable tab or switch 12, and one or more positioning pins (52 and 54 in FIGS. 3 and 4, or 56 in FIGS. 5 to 7).

In preferred aspects, the first and second positioning guides 30 and 40 are located at a proximal end of exercise arm 20. Movement of the moveable tab 12 locks the one or more positioning pins into apertures 32 and 42 in each of the first and second positioning guides 30 and 40. In operation, the user simply moves the tab 12 up to lock the first and second positioning guides 30 and 40 and down to unlock the first and second positioning guides 30 and 40. As such, the user can simultaneously move the exercise arm in two perpendicular directions when the locking and release mechanism 10 has been released (thereby retracting positioning pins 52 and 54 from apertures 32 and 42 in FIGS. 3 and 4, or retracting positioning pin 56 from apertures 32 and 42 in FIGS. 5 to 7).

Referring first to the two pin embodiment of FIGS. 3 and 4, the locking and release mechanism 10 simultaneously moves first positioning pin 52 into one of the apertures 32 in the first positioning guide 30 and the second positioning pin 54 into one of the apertures 42 in the second positioning guide 40. As can be seen, the first and second positioning guides 30 and 40 are preferably perpendicular to one another and the first and second positioning pins 52 and 54 thus move in a plane perpendicular to both of the positioning guides. Specifically, upward rotation of tab 12 simultaneously moves the first and second positioning pins 52 and 54 into the apertures 32 and 34 of the first and second positioning guides 30 and 40 respectively. As can also best be seen in FIG. 4, moveable tab 12 may be connected to a pair of levers 53 and 55, with lever 53 moving positioning pin 52 and lever 55 moving positioning pin 54. Preferably as well, a biasing mechanism keeps tap 12 in its upward locked position (thereby keeping positioning pins 52 and 54 in their locked position in apertures 32 and 42). In operation, the user pushes down on tab 12 to retract positioning pins 52 and 54 and thereby release exercise arm 20 for positioning by the user. Once exercise arm 20 is in the desired position, the user releases tab 12 and the exercise arm is thereby locked into position.

Referring next to the one pin embodiment of FIGS. 5, 6 and 7, the locking and release mechanism 10 moves a single positioning pin 56 into the apertures 32 and 42 in both of the first and second positioning guides 30 and 40. Specifically, a distal end 61 of the single positioning pin 56 locks into the first positioning guide 30 and a proximal end 63 of the single positioning pin 56 locks into the second positioning guide 40. A mid-section 65 of the positioning pin 56 has a smaller diameter than either of the distal 61 end or proximal end 63 of positioning pin 56. As can also be seen the second positioning guide 40 has a continuous slot 43 spanning between the apertures 42 therein. A biasing mechanism (spring 70) is also included. As such, spring 70 keeps positioning pin 56 locked into position (thereby holding both positioning guides 30 and 40 locked in position).

Figure 8A:
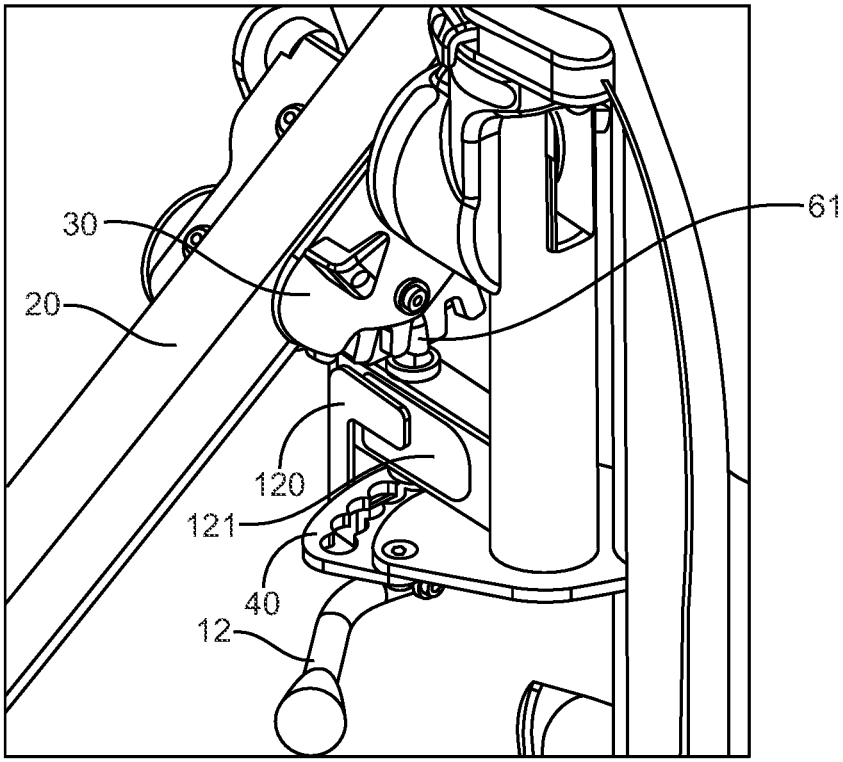
FIG. 8A is a perspective view of an optional safety indicator included on the locking and release mechanism.
Figure 8B:
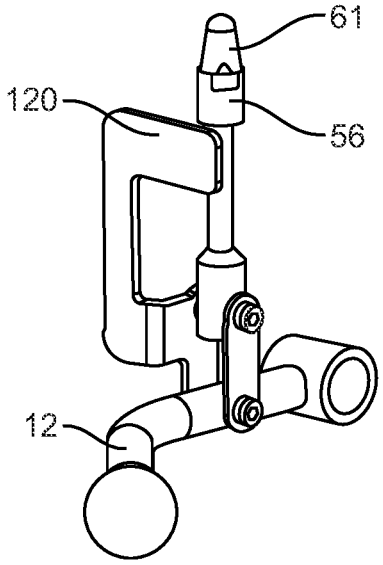
FIG. 8B is a perspective view of the optional safety indicator of FIG. 8A.

FIGS. 8A and 8B show an optional safety indicator 120 included on the locking and release mechanism 10. Safety indicator 120 can be a simple metal "flag" or flange that moves up or down together with positioning pin 56. In the "up" position of FIG. 8A, safety indicator 120 will cover surface 121. A decal can be placed onto surface 121 stating "System Not Ready". When the system is locked into position (such that arms 20 don't move), safety indicator 120 will be in its upper position (covering surface 121) such that the user does not see the "System Not Ready" decal. However, once the user pulls down on switch 12 to unlock the system, then safety indicator 120 will be lowered such that the user then sees the "System Not Ready" decal. This approach provides an easy and convenient way for the user to know when the locking and release mechanism 10 has been released for the user to move arms 20.

Figure 9A:
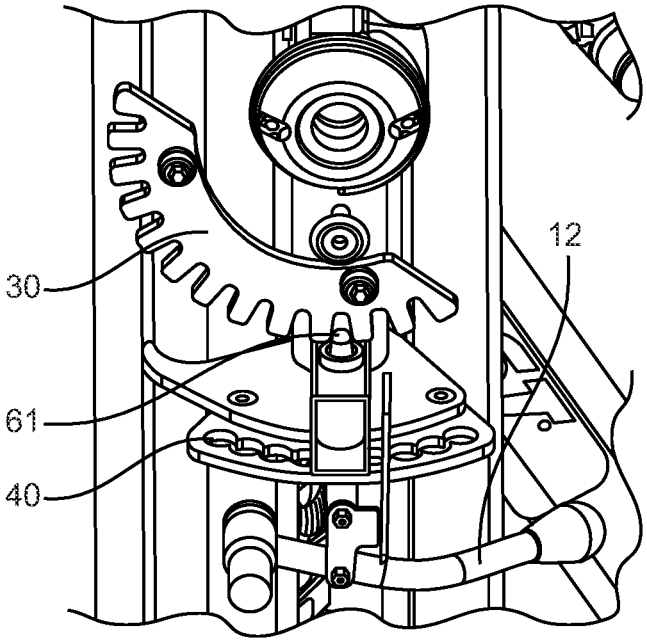
FIG. 9A is a top perspective view of an optional safety device for releasing the arm for horizontal movement immediately prior to releasing the arm for vertical movement.
Figure 9B:
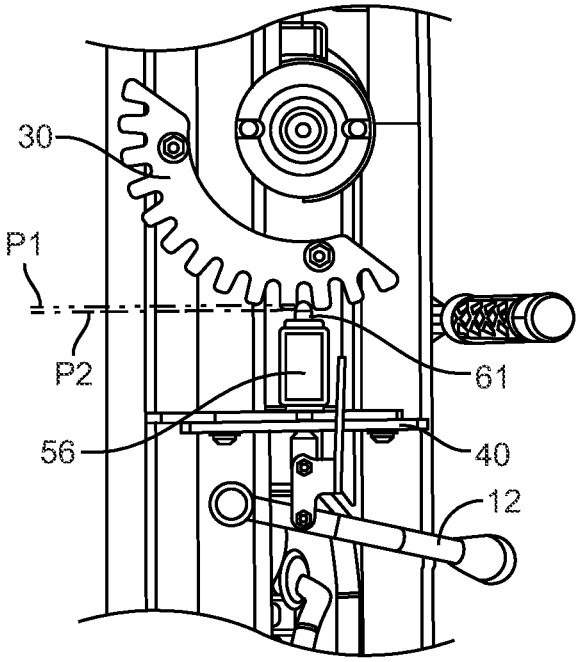
FIG. 9B is a side elevation view of the optional safety device of FIG. 9A.

FIGS. 9A and 9B provide another optional safety feature in which positioning pin 56 is dimensioned such that it releases positioning guide 40 just prior to releasing positioning guide 30. Specifically, when the top end 61 of positioning pin 56 at position P1 (i.e.: still holding positioning guide 30) when the lower portion of positioning pin 56 releases from itself from positioning guide 40). Later, as switch 12 is pulled farther down, the top end 61 of positioning pin 56 is pulled down to position P2, at which time positioning guide 30 will also be released. This has the benefit of releasing arm 20 for horizontal movement prior to vertical movement. As a result, arm 20 will not simply fall down (i.e.: onto the user) when released for re-positioning.

Figure 10A:
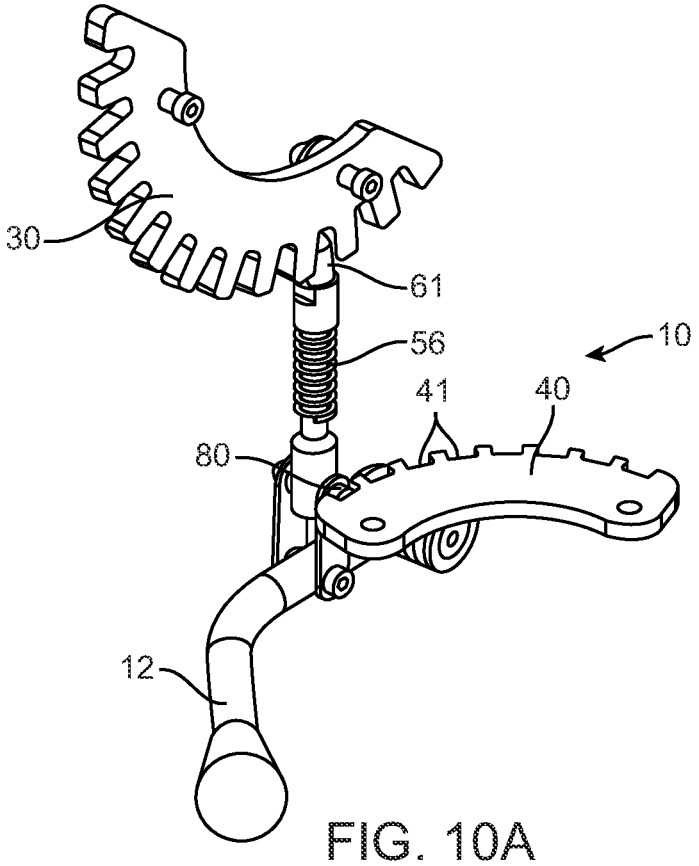
FIG. 10A is a top perspective view of an embodiment of the present system in which a bolt engages a sawtooth edge on the horizontal positioning guide.
Figure 10B:
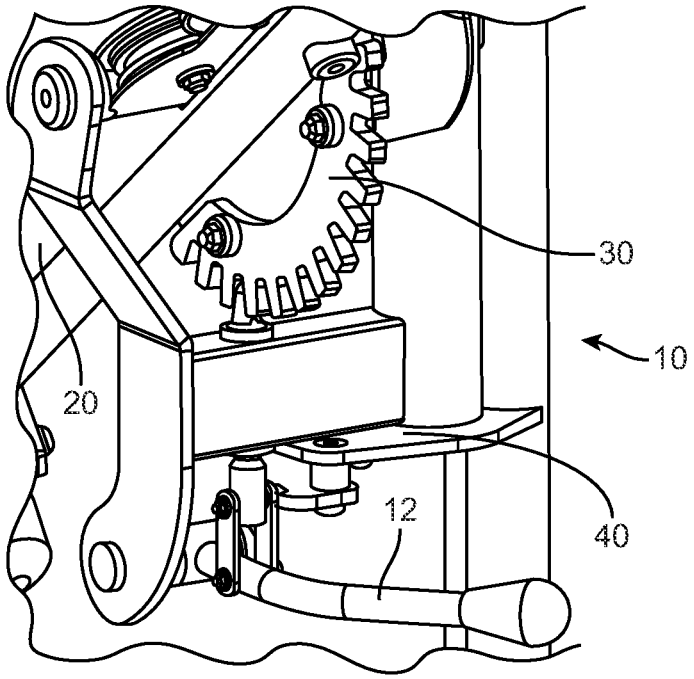
FIG. 10B is a perspective view corresponding to the embodiment of FIG. 10A.

FIGS. 10A and 10B show an embodiment of the present system in which a bolt 80 engages a sawtooth edge 41 on the horizontal positioning guide 40.

Figure 11A:
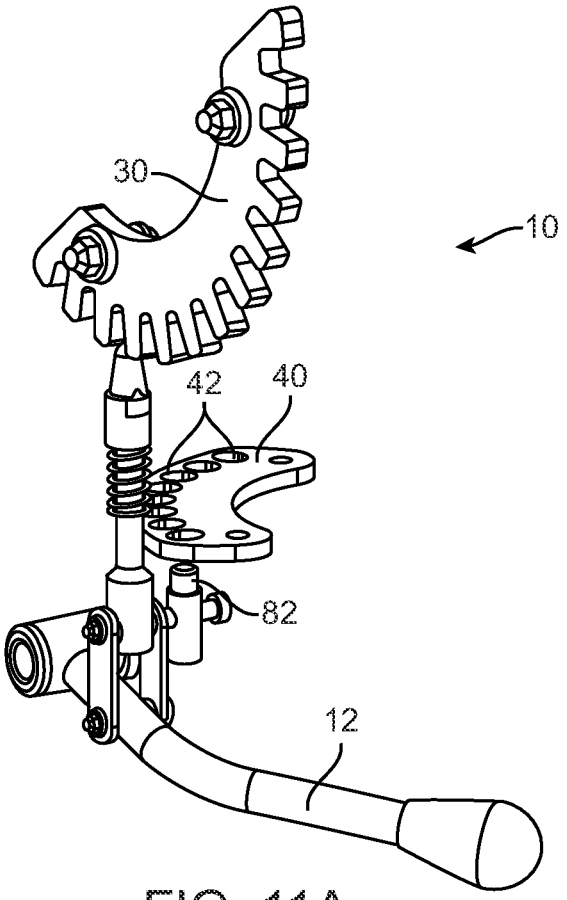
FIG. 11A is a top perspective view of an embodiment of the present system in which a parallel bolt engages the horizontal positioning guide.
Figure 11B:
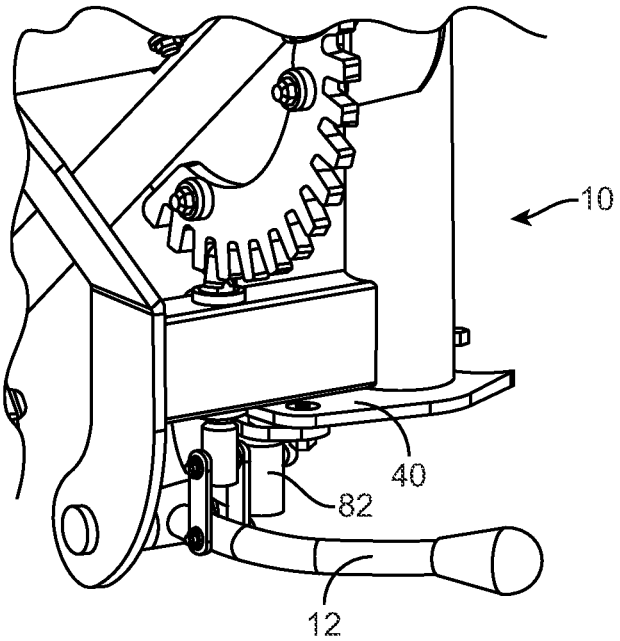
FIG. 11B is a perspective view corresponding to the embodiment of FIG. 11A.

Lastly, FIGS. 11A and 11B show an embodiment of the present system in which a parallel bolt 82 engages the apertures 42 in horizontal positioning guide 40.

What is claimed is:

1. A locking and release mechanism for simultaneously positioning an exercise arm in two perpendicular directions, comprising:

(a) an exercise arm;

(b) a first positioning guide for positioning the exercise arm in a first direction;

(c) a second positioning guide for positioning the exercise arm in a second direction, wherein the first and second directions are perpendicular to one another; and (d) a locking and release mechanism for locking and releasing the first and second positioning guides, wherein the locking and release mechanism comprises:

(i) a moveable tab, and (ii) one or more positioning pins, wherein movement of the moveable tab locks the one or more positioning pins into apertures in each of the first and second positioning guides.

2. The mechanism of claim 1, wherein the locking and release mechanism simultaneously moves a first positioning pin into one of the apertures in the first positioning guide and a second positioning pin into one of the apertures in the second positioning guide.

3. The mechanism of claim 2, wherein the first and second positioning guides are perpendicular to one another and the first and second positioning pins move in a plane perpendicular to both positioning guides.

4. The mechanism of claim 2, wherein rotation of the tab simultaneously moves the first and second positioning pins into the apertures of the first and second positioning guides respectively.

5. The mechanism of claim 2, wherein the moveable tab is connected to a pair of levers, and one of the pair of levers moves each of the first and second positioning pins.

6. The mechanism of claim 2, wherein the locking and release mechanism further comprises a biasing mechanism for keeping the first and second positioning pins in a locked position.

7. The mechanism of claim 1, wherein the locking and release mechanism moves a single positioning pin into the apertures in both of the first and second positioning guides.

8. The mechanism of claim 7, wherein a distal end of the single positioning pin locks into the first positioning guide and a proximal end of the single positioning pin locks into the second positioning guide.

9. The mechanism of claim 8, wherein a mid-section of the positioning pin has a smaller diameter than either of the distal or proximal ends of the positioning pin, and wherein the second positioning guide has a continuous slot spanning between the apertures therein.

10. The mechanism of claim 7, wherein the locking and release mechanism further comprises a biasing mechanism for keeping the positioning pin in a locked position.

11. The mechanism of claim 7, wherein the positioning pin releases the first and second positioning guides at different times.

12. The mechanism of claim 1, wherein the first and second positioning guides are located at a proximal end of the exercise arm.

13. The mechanism of claim 1, wherein a user is capable of moving the tab up to lock the first and second positioning guides and down to unlock the first and second positioning guides.

14. The mechanism of claim 1, wherein the user is capable of simultaneously moving the exercise arm in two perpendicular directions when the locking and release mechanism has been released.

15. The mechanism of claim 1, wherein the locking and release mechanism comprises a flange that is moveable over a warning decal when the locking and release mechanism is unlocked.

* * * * *